US010501157B2

(12) United States Patent
Chen et al.

(10) Patent No.: US 10,501,157 B2
(45) Date of Patent: Dec. 10, 2019

(54) UNDERWATER RESCUE SYSTEM

(71) Applicants: Zhejiang Ocean University, Zhoushan, Zhejiang (CN); Marine Design & Research Institute of China, Shanghai (CN)

(72) Inventors: Lin Chen, Zhenjiang (CN); Ximing Tian, Shanghai (CN); Huaming Wang, Zhenjiang (CN)

(73) Assignees: Zhejiang Ocean University, Zhoushan (CN); Marine Design & Research Institute of China, Shanghai (CN)

( * ) Notice: Subject to any disclaimer, the term of this patent is extended or adjusted under 35 U.S.C. 154(b) by 0 days.

(21) Appl. No.: 16/367,413

(22) Filed: Mar. 28, 2019

(65) Prior Publication Data

US 2019/0300134 A1 Oct. 3, 2019

(30) Foreign Application Priority Data

Mar. 30, 2018 (CN) ..... 201810288761

(51) Int. Cl.

| | |
|---|---|
| ***B63C 11/34*** | (2006.01) |
| ***B63C 9/06*** | (2006.01) |
| ***B63C 9/18*** | (2006.01) |
| *B63C 9/00* | (2006.01) |

(52) U.S. Cl.

CPC ..... *B63C 9/065* (2013.01); *B63C 9/18* (2013.01); *B63C 11/34* (2013.01); *B63C 2009/007* (2013.01)

(58) Field of Classification Search

CPC ..... B63C 9/065; B63C 9/18; B63C 2009/007; B63C 11/34

See application file for complete search history.

(56) References Cited

U.S. PATENT DOCUMENTS

| | | | | | |
|---|---|---|---|---|---|
| 3,706,206 | A * | 12/1972 | Clark | B63C 11/34 | 405/185 |
| 5,713,710 | A * | 2/1998 | Strong | B63B 27/10 | 414/139.5 |
| 5,816,183 | A * | 10/1998 | Braud | B63B 22/021 | 114/230.13 |
| 6,817,809 | B2 * | 11/2004 | Choi | B63B 27/24 | 114/230.13 |
| 2007/0248417 | A1 * | 10/2007 | Berg | B65H 75/364 | 405/158 |

(Continued)

*Primary Examiner* — Stephen P Avila

(74) *Attorney, Agent, or Firm* — Wayne & Ken, LLC; Tony Hom

(57) ABSTRACT

An underwater rescue system, including a submersible and a rescue cage. The submersible includes a housing, a turntable and a motor. The turntable is rotatably arranged at an outer surface of the housing. The motor is fixed on the housing and connected to the turntable. The rescue cage includes a connecting rod, a first lifebuoy, a second lifebuoy and an air charging device. A lower end of the connecting rod is provided with an electromagnetic chuck attracting the turntable. An upper end of the connecting rod is connected to the first lifebuoy. A bottom of the first lifebuoy is provided with a load-bearing net. A side of the first lifebuoy is connected to the second lifebuoy by a net bag. The air charging device communicates with the first and second lifebuoys and is configured to charge air to the first and second lifebuoys.

7 Claims, 3 Drawing Sheets

(56) References Cited

U.S. PATENT DOCUMENTS

| | | | | |
|---|---|---|---|---|
| 2009/0209154 | A1* | 8/2009 | Lunde | B63B 22/023 441/5 |
| 2015/0120152 | A1* | 4/2015 | Lauterjung | E06C 5/18 701/49 |
| 2016/0176692 | A1* | 6/2016 | Sawodny | B66F 17/006 701/50 |
| 2017/0252583 | A1* | 9/2017 | Goeltz | A62B 1/02 |

* cited by examiner

UNDERWATER RESCUE SYSTEM

CROSS-REFERENCE TO RELATED APPLICATIONS

This application claims the benefit of priority from Chinese Patent Application No. CN201810288761.X, filed on Mar. 30, 2018. The content of the aforementioned application, including any intervening amendments thereto, is incorporated herein by reference in its entirety.

TECHNICAL FIELD

The present application relates to underwater rescue, and more particularly to an underwater rescue system.

BACKGROUND OF THE INVENTION

Time plays a key role in underwater rescue. Action in a shortened time period may result in a great chance of successful rescue. However, at present, the underwater rescue technology is still imperfect worldwide. Specifically, the underwater rescue is time-consuming, and has difficulty in rescue operations and inadequate supporting facilities, so their applications are greatly limited.

SUMMARY OF THE INVENTION

An object of the application is to provide an underwater rescue system in view of the above problems in the prior art. The technical problem to be solved by the application is how to improve the efficiency of underwater rescue.

An underwater rescue system includes a submersible and a rescue cage. The submersible includes a housing, a turntable and a motor. The turntable is rotatably arranged at an outer surface of the housing. The motor is fixed on the housing and connected to the turntable. The rescue cage includes a connecting rod, a first lifebuoy, a second lifebuoy and an air charging device. A diameter of the first lifebuoy is greater than that of the second lifebuoy. A lower end of the connecting rod is provided with an electromagnetic chuck attracting the turntable. An upper end of the connecting rod is connected to the first lifebuoy. A bottom of the first lifebuoy is provided with a load-bearing net. A side of the first lifebuoy is connected to the second lifebuoy through a net bag. The air charging device is in communication with the first lifebuoy and the second lifebuoy, and is configured to charge air to the first lifebuoy and the second lifebuoy.

The underwater rescue system works as follows. In use, the submersible is first driven to a position close to and below those drowning, and then the turntable is driven by the motor to rotate to adjust the position of the rescue cage, so that the rescue cage is positioned just under the drowning person. After that, the first lifebuoy and the second lifebuoy are charged with air by the air charging device so that the second lifebuoy rises and pulls the net bag to stretch and form a cage body. The connecting rod is separated from the turntable by the electromagnetic chuck. The rescue cage begins to rise to lift the drowning out of the water under the action of the first lifebuoy and the second lifebuoy. Since the first lifebuoy is provided with the connecting rod and the electromagnetic chuck, the rescue cage is kept stretched to facilitate the rescue. The submersible and the air charging device in the present application may be available in the prior art. Commonly used airbags can be employed as the first lifebuoy and the second lifebuoy, which are not further described herein.

In some embodiments, the motor is waterproof.

In some embodiments, the first lifebuoy is provided with a plurality of wire loops which are connected to a cable. An end of the cable is connected to the upper end of the connecting rod. The connecting rod is fixed by the cable and is flexibly connected to the cable, so that the first lifebuoy can be kept in a horizontal position to prevent the drowning from slipping out of the rescue cage regardless of the changes in direction of the connecting rod.

In some embodiments, the connecting rod includes a first cylinder and a rod body. An upper end of a cylinder body of the first cylinder is connected to an end of the cable. An upper end of a piston rod of the first cylinder is plugged into the cylinder body of the first cylinder. A lower end of the piston rod of the first cylinder is connected to an upper end of the rod body. A lower end of the rod body is connected to the electromagnetic chuck. The first cylinder is configured to make the connecting rod retractable so that the position of the rescue cage can be easily adjusted to allow the rescue cage to move quickly to a position below the drowning person.

In some embodiments, the lower end of the rod body is hinged to the electromagnetic chuck and a second cylinder is provided between the rod body and the electromagnetic chuck. Two ends of the second cylinder are respectively hinged to the rod body and the electromagnetic chuck. After the second cylinder is provided, a relative angle between the rod body and the electromagnetic chuck may be adjusted to quickly adjust the position of the rescue cage, thereby improving the rescue efficiency.

In some embodiments, the net bag includes a plurality of net ropes connected to the first lifebuoy and the second lifebuoy. A plurality of passages are formed by the plurality of net ropes for air to pass through. Two sides of each passage are respectively connected to an inner cavity of the first lifebuoy and an inner cavity of the second lifebuoy. The air charging device includes an air cylinder which is fixed to the cylinder body of the first cylinder. The air cylinder is in communication with the inner cavity of the first lifebuoy. The first lifebuoy can be substantially filled with air first by the air cylinder to be roughly circular, so that the rescue cage can be easily aligned with the position under the drowning person. The air charging is continued so that the air can enter and gradually fill the second lifebuoy via the passages of the net ropes to shape the rescue cage, which contributes to the rescue.

In some embodiments, the second lifebuoy is provided a plurality of lifting rings. The lifting rings are made of PVC transparent steel wired hoses in which LED lights are embedded. The LED lights can not only help the rescue boat to quickly find the drowning person when he is out of the water, but also help to guide the engagement of a crane on the rescue boat and the lifting rings, especially in a dark environment.

Compared to the prior art, the application has the following beneficial effects.

When the underwater rescue system is in use, the submersible is first driven to a position close to and below a drowning person, and then the turntable is driven to rotate by the motor to adjust a position of the rescue cage, so that the rescue cage is just under the drowning person. After that, the first lifebuoy and the second lifebuoy are charged with air by the air charging device so that the second lifebuoy rises and pulls the net bag to stretch and form a cage body. The connecting rod is separated from the turntable by the electromagnetic chuck. The rescue cage begins to rise to lift the drowning person out of the water surface under the action of the first lifebuoy and the second lifebuoy. Since the first lifebuoy is provided with the connecting rod and the electromagnetic chuck, the rescue cage is kept stretched to facilitate the rescue.

Figure 1:
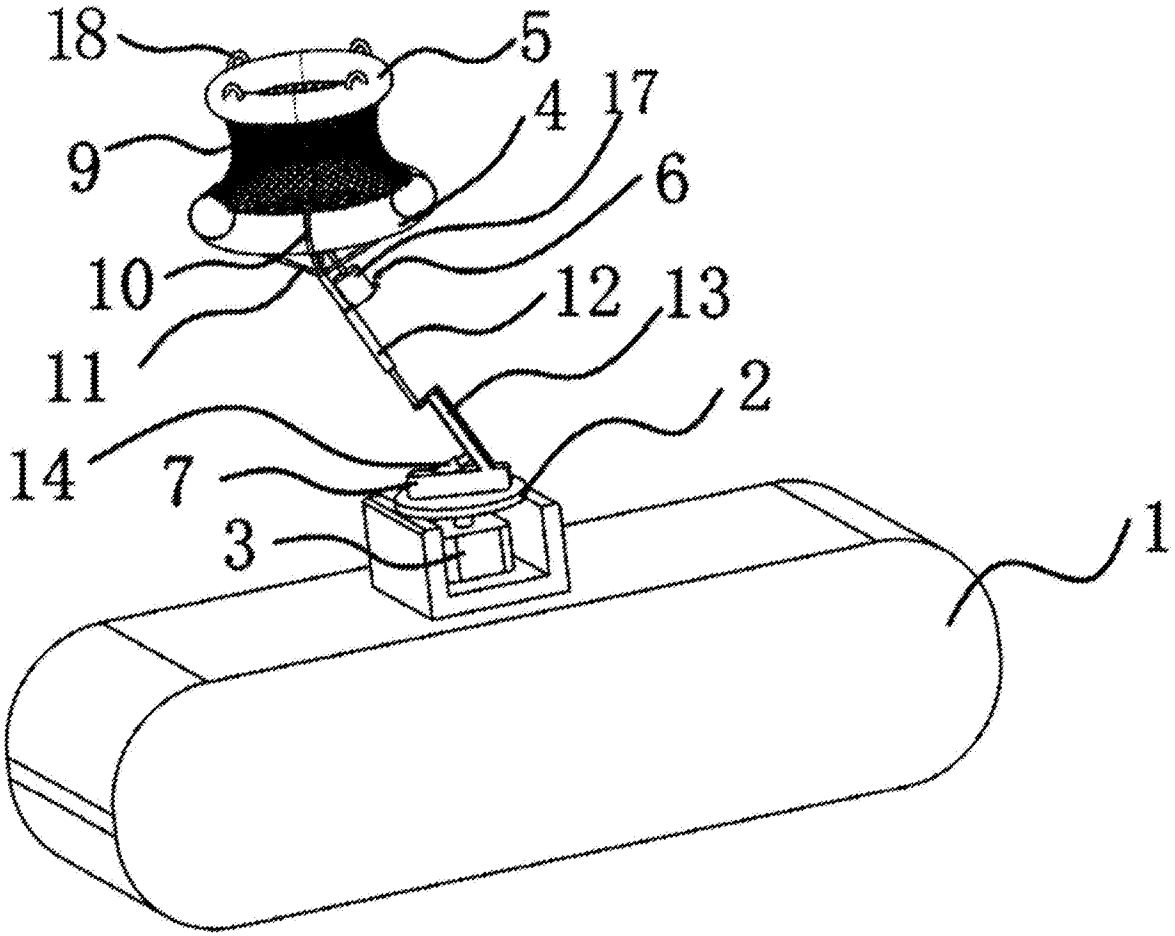
FIG. 1 is a schematic diagram of an underwater rescue system according to the present invention.

In the drawings, 1, housing; 2, turntable; 3, motor; 4, first lifebuoy; 5, second lifebuoy; 6, air charging device; 7, electromagnetic chuck; 8, load-bearing net; 9, net bag; 10, wire loop; 11, cable; 12, first cylinder; 13, rod body; 14, second cylinder; 15, net rope; 16, passage; 17, air cylinder; and 18, lifting ring.

DETAILED DESCRIPTION OF EMBODIMENTS

The invention will be further described below with reference to embodiments and accompanying drawings, but the invention is not limited to these embodiments.

Figure 2:
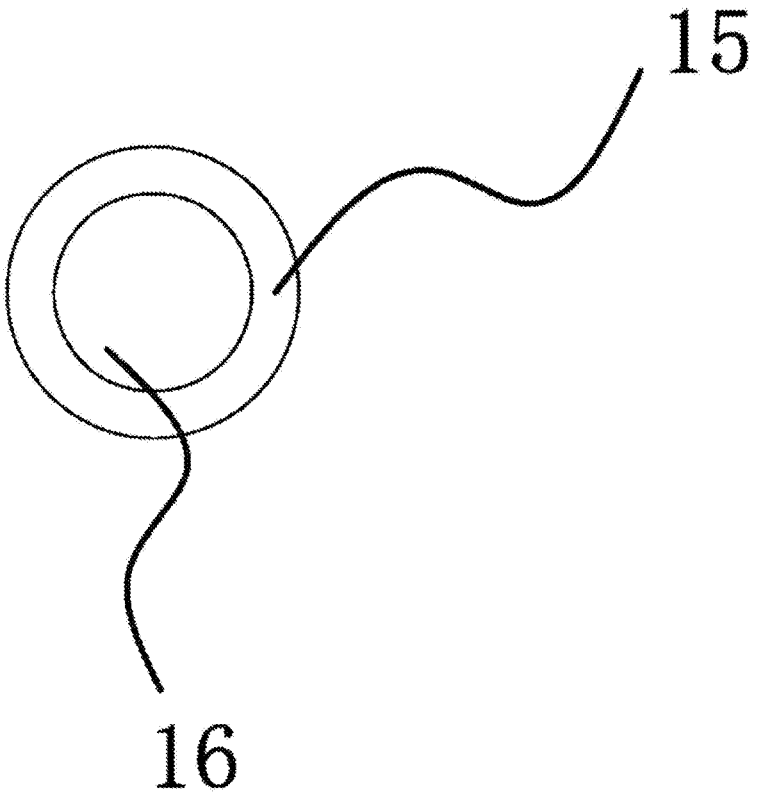
FIG. 2 is a schematic sectional view of a net bag.
Figure 3:
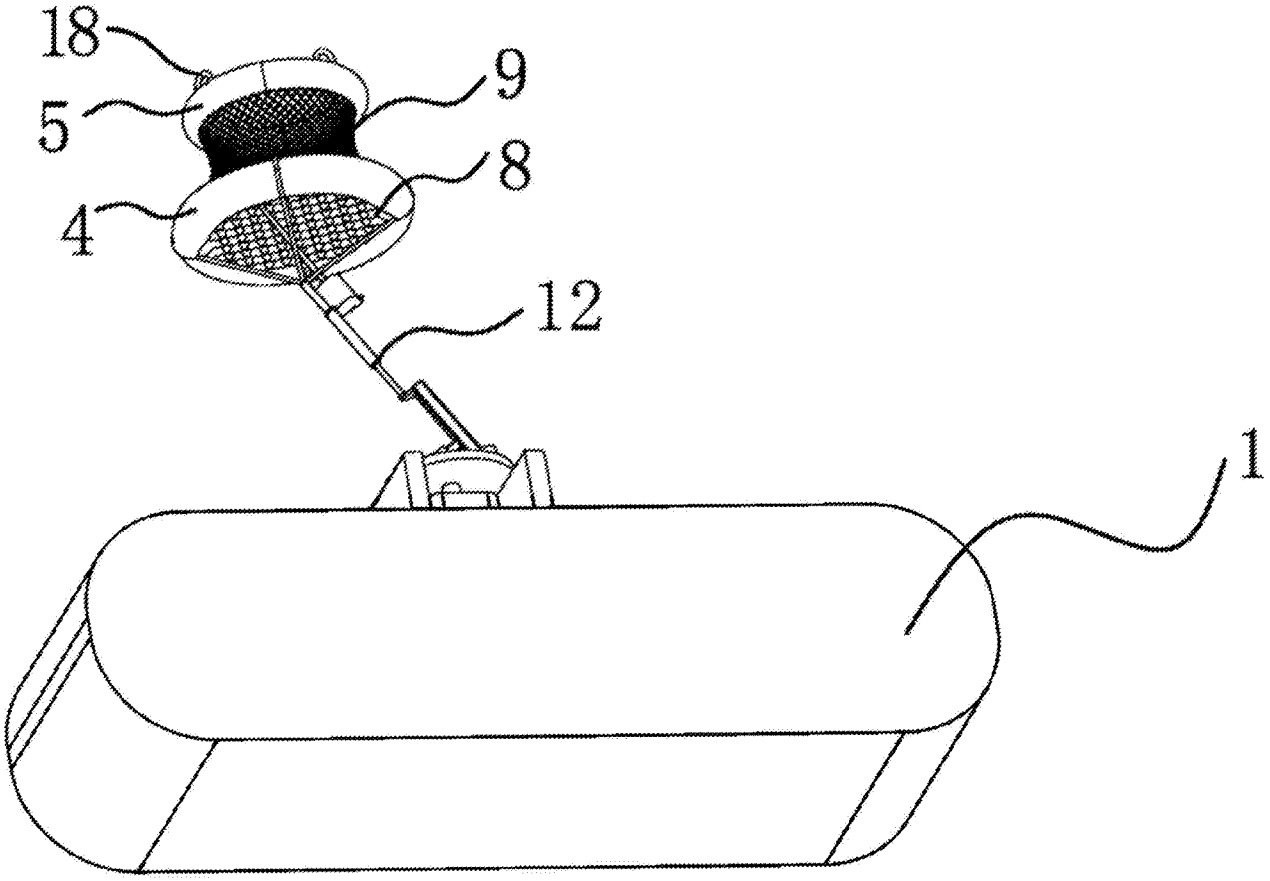
FIG. 3 is a schematic diagram of the underwater rescue system according to the present invention from another perspective.

As shown in FIGS. 1-3, an underwater rescue system of the invention includes a submersible and a rescue cage. The submersible includes a housing 1, a turntable 2 and a motor 3. The turntable 2 is rotatably arranged at an outer surface of the housing 1. The motor 3 is fixed on the housing 1 and is connected to the turntable 2. Preferably, the motor 3 in this embodiment is waterproof.

As shown in FIGS. 1-3, the rescue cage includes a connecting rod, a first lifebuoy 4, a second lifebuoy 5 and an air charging device 6. A lower end of the connecting rod is provided with an electromagnetic chuck 7 attracting the turntable 2. An upper end of the connecting rod is connected to the first lifebuoy 4. A bottom of the first lifebuoy 4 is provided with a load-bearing net 8. A side of the first lifebuoy 4 is connected to the second lifebuoy 5 through a net bag 9. The air charging device 6 is in communication with the first lifebuoy 4 and the second lifebuoy 5, and is configured to charge air to the first lifebuoy 4 and the second lifebuoy 5. Specifically, the first lifebuoy 4 is provided with a plurality of wire loops 10 which are connected to a cable 11, and an end of the cable 11 is connected to the upper end of the connecting rod. The connecting rod includes a first cylinder 12 and a rod body 13. An upper end of a cylinder body of the first cylinder 12 is connected to an end of the cable 11. An upper end of a piston rod of the first cylinder 12 is plugged into the cylinder body of the first cylinder 12. A lower end of the piston rod of the first cylinder is connected to an upper end of the rod body 13. A lower end of the rod body 13 is connected to the electromagnetic chuck 7. The lower end of the rod body 13 is hinged to the electromagnetic chuck 7 and a second cylinder 14 is provided between the rod body 13 and the electromagnetic chuck 7. Two ends of the second cylinder 14 are respectively hinged to the rod body 13 and the electromagnetic chuck 7. The net bag 9 includes a plurality of net ropes 15 which are connected to the first lifebuoy 4 and the second lifebuoy 5. A plurality of passages 16 are formed by the plurality of net ropes 15 for air to pass through. Two sides of each passage 16 are respectively connected to an inner cavity of the first lifebuoy 4 and an inner cavity of the second lifebuoy 5. The air charging device 6 includes an air cylinder 17 which is fixed to the cylinder body of the first cylinder 12. The air cylinder 17 is in communication with the inner cavity of the first lifebuoy 4. The second lifebuoy 5 is provided with a plurality of lifting rings 18. The lifting rings 18 are made of PVC transparent steel wired hoses in which LED lights are embedded.

The underwater rescue system of the invention works as follows. In use, the submersible is first driven to be close to a position under a drowning person, and then the turntable 2 is driven by the motor 3 to rotate to adjust a position of the rescue cage, so that the rescue cage is just under the drowning person. After that, the first lifebuoy 4 and the second lifebuoy 5 are charged with air by the air charging device 6 so that the second lifebuoy 5 rises and pulls the net bag 9 to stretch and form a cage body. The connecting rod is separated from the turntable 2 by the electromagnetic chuck 7. The rescue cage begins to rise to lift the drowning person out of the water surface under the action of the first lifebuoy 4 and the second lifebuoy 5. Since the first lifebuoy 4 is provided with the connecting rod and the electromagnetic chuck 7, the whole rescue cage is kept stretched to facilitate the rescue.

These embodiments are merely used to exemplarily illustrate the spirit of the invention. Those skilled in the art can make various modifications or additions to the embodiments or make substitutions in a similar way without departing from the spirit of the invention, which should still fall within the scope defined by the appended claims.

What is claimed is:

1. An underwater rescue system, comprising:

a submersible, and a rescue cage;

wherein the submersible comprises a housing, a turntable and a motor; the turntable is rotatably arranged at an outer surface of the housing; the motor is fixed on the housing and is connected to the turntable; the rescue cage comprises a connecting rod, a first lifebuoy, a second lifebuoy and an air charging device, wherein a diameter of the first lifebuoy is greater than that of the second lifebuoy;

a lower end of the connecting rod is provided with an electromagnetic chuck attracting the turntable; an upper end of the connecting rod is connected to the first lifebuoy;

a bottom of the first lifebuoy is provided with a load-bearing net;

a side of the first lifebuoy is connected to the second lifebuoy by a net bag; and the air charging device is in communication with the first lifebuoy and the second lifebuoy, and is configured to charge air to the first lifebuoy and the second lifebuoy.

2. The underwater rescue system of claim 1, wherein the motor is waterproof.

3. The underwater rescue system of claim 1, wherein the first lifebuoy is provided with a plurality of wire loops which are connected to a cable, and an end of the cable is connected to the upper end of the connecting rod.

4. The underwater rescue system of claim 3, wherein the connecting rod comprises a first cylinder and a rod body; an upper end of a cylinder body of the first cylinder is connected to an end of the cable; an upper end of a piston rod of the first cylinder is plugged into the cylinder body of the first cylinder; a lower end of the piston rod of the first cylinder is connected to an upper end of the rod body; and a lower end of the rod body is connected to the electromagnetic chuck.

5. The underwater rescue system of claim 4, wherein the lower end of the rod body is hinged to the electromagnetic chuck; a second cylinder is provided between the rod body and the electromagnetic chuck; two ends of the second cylinder are respectively hinged to the rod body and the electromagnetic chuck.

6. The underwater rescue system of claim 5, wherein the net bag comprises a plurality of net ropes which are connected to the first lifebuoy and the second lifebuoy; a plurality of passages are formed by the plurality of net ropes for air to pass through; two sides of each passage are respectively connected to an inner cavity of the first lifebuoy and an inner cavity of the second lifebuoy; the air charging device comprises an air cylinder which is fixed to the cylinder body of the first cylinder; and the air cylinder is in communication with the inner cavity of the first lifebuoy.

7. The underwater rescue system of claim 6, wherein the second lifebuoy is provided a plurality of lifting rings made of PVC transparent steel wired hoses in which an LED light are embedded.

* * * * *